United States Patent [19]

Laske

[11] 3,952,975

[45] *Apr. 27, 1976

[54] INFLATABLE KITE

[75] Inventor: Louis Lawrence Laske, Grayslake, Ill.

[73] Assignee: Vonco Products, Inc., Lake Villa, Ill.

[ * ] Notice: The portion of the term of this patent subsequent to Apr. 2, 1988, has been disclaimed.

[22] Filed: May 13, 1974

[21] Appl. No.: 469,116

Related U.S. Application Data

[63] Continuation-in-part of Ser. No. 347,879, April 4, 1973, abandoned.

[52] U.S. Cl. ..... 244/153 R; 244/DIG. 1

[51] Int. Cl.[2] ..... A63H 27/08

[58] Field of Search ..... 244/153 R, 153 A, 154, 244/16, 33, DIG. 1; D34/15 AF

[56] References Cited

UNITED STATES PATENTS

| | | | |
|---|---|---|---|
| 2,434,077 | 1/1948 | Lang | D34/15 AF |
| 3,093,354 | 6/1963 | Pohl | 244/154 R |
| 3,110,460 | 11/1963 | Koonce et al. | 244/153 R |
| 3,270,895 | 9/1966 | Stewart | 244/153 R |
| 3,335,985 | 8/1967 | Neal | 244/153 R |
| D223,716 | 5/1972 | Choong | D34/15 AF |
| D231,113 | 4/1974 | Laske | 244/153 R X |
| D231,245 | 4/1974 | Christoffel | D34/15 AF |
| D232,961 | 9/1974 | Laske | 244/153 R X |

FOREIGN PATENTS OR APPLICATIONS

| | | | |
|---|---|---|---|
| 614,064 | 12/1960 | Italy | 244/16 |

*Primary Examiner*—Frank E. Werner
*Assistant Examiner*—Donald W. Underwood
*Attorney, Agent, or Firm*—Thomas W. Speckman

[57] ABSTRACT

An inflatable kite exhibiting excellent lift and stability characteristics without an auxiliary tail, even in small size kites from about 12 to about 18 inches long. The kite of this invention comprises an inflatable body member provided with a rounded leading edge and having a substantially teardrop shape, two inflatable opposing rearwardly projecting side members attached to said body member and together forming a single inflated volume, a web of flexible sheet material connected between each side member and said body member and extending over at least about 50 percent of the area defined by said body member, the side member and a straight line joining the rear extremities of said body member and said side member, and a line attachment means bonded to said body member, the ratio of the maximum width to the length of the inflated kite being about 0.5 to 1.5; the rounded nose portion being discontinuous with the outer edges of the projecting side members by having lateral projections continuous with the rounded nose portion and a narrow neck portion ahead of the attachment of the projecting side members to the body.

12 Claims, 7 Drawing Figures

INFLATABLE KITE

CROSS REFERENCE TO RELATED APPLICATION

This application is a continuation-in-part of my pending application, Ser. No. 347,879, filed Apr. 4, 1973 now abandoned.

Related design patents and applications are as follows:

Design U.S. Pat. No. 231,112, patented Apr. 2, 1974
Design U.S. Pat. No. 231,113, patented Apr. 2, 1974
Design U.S. Pat. No. 232,961, patented Sept. 24, 1974
Design U.S. application No. 469,066, filed May 13, 1974.

This invention relates to inflatable kites having improved lift and stability characteristics.

The kite of this invention exhibits excellent flight characteristics in mild breezes as well as in high winds without the requirement of an auxiliary tail. The kite of this invention affords several advantages as a toy or recreational device since it has excellent lift and stability, rendering it an easy and satisfying kite for children. Further, the kite of this invention, when deflated, may be folded or rolled into a compact package and requires only inflation and the attachment of string to ready it for flight. As compared with conventional paper and box kites having sticks or other breakable structures, the kites of this invention are only subject to punctures which can be readily repaired.

Many of the kites known prior to this invention do not perform satisfactorily when produced in small sizes necessary when used as premiums. To be used as premiums, economics dictates that the kites be of a small size, in the range of 12 to 18 inches in length. Many kites which perform well in flight, when reduced to the size necessary for use as premiums, do not perform well. The kite of this invention has been found to perform well in a wide variety of sizes making it an excellent flyer in a small size necessary as a premium with the purchase of another item as well as in a large size so that the kite may serve advantageously in emergency situations such as raising an antenna for emergency radio, serving as a radar reflector, and the like.

The advantages of this invention will become more apparent in the drawings in which the kite is shown inflated wherein.

Figure 1:
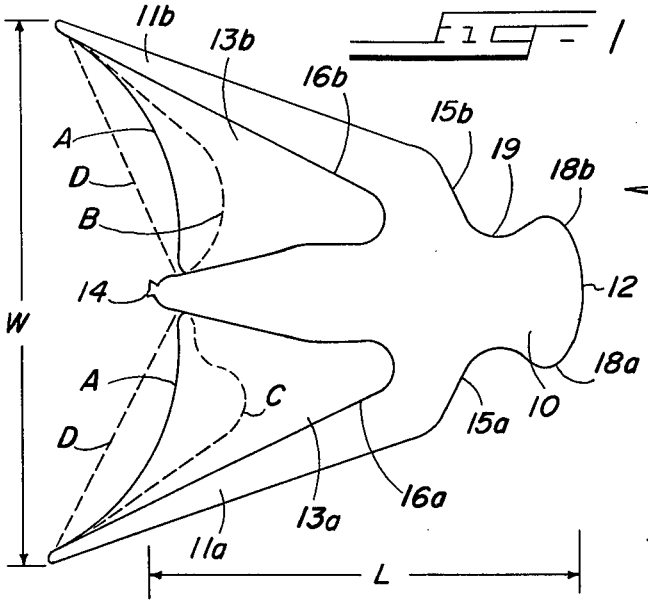
FIG. 1 is a top view of a kite of one preferred embodiment of this invention.

Referring to FIG. 1, a kite of this invention may be generally described as having an inflatable hollow body member 10 with a rounded leading edge and having substantially teardrop shape. Two opposing rearwardly projecting side members 11*a* and 11*b* are attached to the body member and together form a single inflatable volume. The substantially teardrop shape may be best seen in FIG. 3, a side elevational view of the kite of FIG. 1. Body member 10 and rearwardly projecting side members 11*a* and 11*b* may be inflated with air, or any lifting gas, through a single opening provided by vent means 14. Webs 13a and 13b connect each of the side members 11a and 11b, respectively, to body member 10. Webs 13a and 13b are not inflated, but are flexible sheets.

To achieve the object of excellent stability for kites of this invention, the kites must have a generally rounded nose portion shown in FIG. 1 as 12. To achieve maximum stability of the kites, especially small size kites of down to about 12 inches in length, the rounded nose portion is discontinuous with the outer edges of the projecting side members 11*a* and 11*b* by having lateral projections 18*a* and 18*b*, their leading edge being continuous with the rounded nose portion. The lateral projections are shaped into a narrow neck portion 19 which is smoothly shaped at the rearward end into shoulders 15*a* and 15*b*. I have found that the rounded nose with lateral projections and a narrower neck section is desired for the kite of this invention, resulting in better stability without a tail, especially in small sizes, while retaining excellent lift characteristics. The width across the lateral projections is about 15 to about 200 percent greater than the width of the kite across the neck section, preferably about 25 to about 100 percent greater than the width across the neck section. The width of the neck section is about 10 to about 30 percent of the width of the kite shown as W in FIG. 1.

Figure 4:
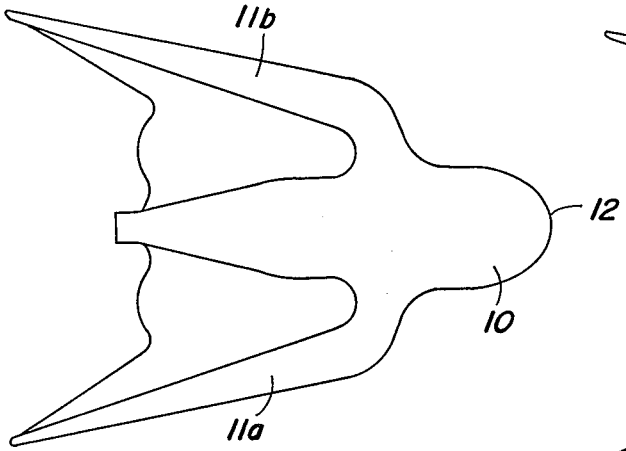
FIG. 4 is a top view of a kite showing one preferred embodiment of the invention of my prior application.
Figure 5:
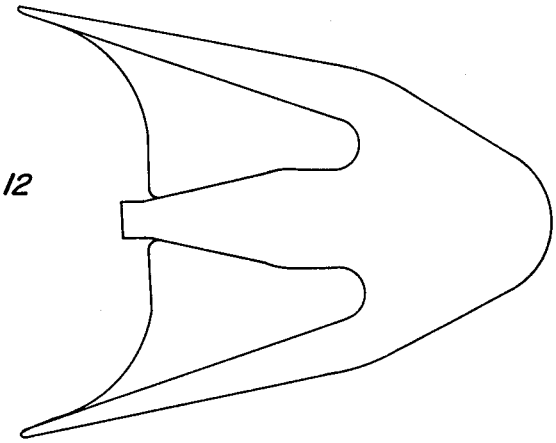
FIG. 5 is a top view of a kite showing one preferred embodiment of the invention of my prior application.

FIGS. 4 and 5 show kites disclosed in my above identified pending application. For comparison, kites having the designs shown in FIGS. 1, 4 and 5, all 13 inches in length and 20 inches in width inflated, were flown without tails and having the different nose portions as shown. The stability of the kite, ability to remain in flight having its string tied to a fixed point, was rated on a 1 to 10 scale: 10 - flew without being affected by normal wind conditions; 5 - flew with minimum wind conditions but would roll or dive with greater wind velocities; and 1 - raises off ground but dives upon string tightening. The kite of this invention shown in FIG. 1 was rated at 8; the kite shown in FIG. 4 was rated 5–6; while the kite shown in FIG. 5 was rated 6–7. The kites shown in FIGS. 4 and 5, disclosed in my pending application, showed superior stability when compared to other commercially available inflated kites. The kite of FIG. 1 in large sizes, about 23 inches in length, was rated 9–10. Further, the kite of the design shown in FIG. 1 showed almost 50 percent reduction in the stress and elongation of the polymer sheet at the point of attachment of the two rearwardly projecting side members with the body member, a point at which the highest incidence of failure has resulted in kites of the type of FIG. 5.

Figure 6:
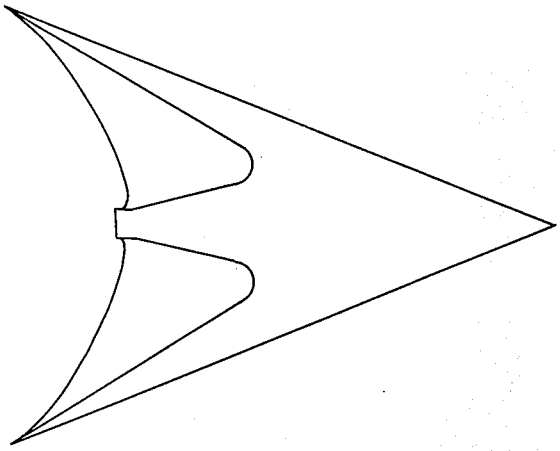
FIG. 6 is a top view of a kite shown for comparative purposes.

By comparison with the kite of this invention as shown in FIG. 1, the kite shown in FIG. 6 having a pointed nose, and otherwise being of the same size and proportions as the kite in FIG. 1, showed a considerable loss of stability.

I have also found that to achieve the objects of this invention, it is desirable that the two rearwardly projecting side members 11*a* and 11*b* extend rearwardly about as far as body member 10 and preferably further. The side members may be straight cylindrical or rearwardly tapered in shape. The side members may be curved either outwardly or inwardly. It is preferred that the side members extend rearwardly beyond the body and be tapered to a point at their extremities. A kite for comparison was constructed of the same size and the same proportions as FIG. 1 except the rearwardly projecting side members and a corresponding portion of the webs were removed, making the side members shorter than body member. This kite lost considerable lift and was not a satisfactory flying kite as a result of great loss of stability as compared with the kite shown in FIG. 1.

Figure 7:
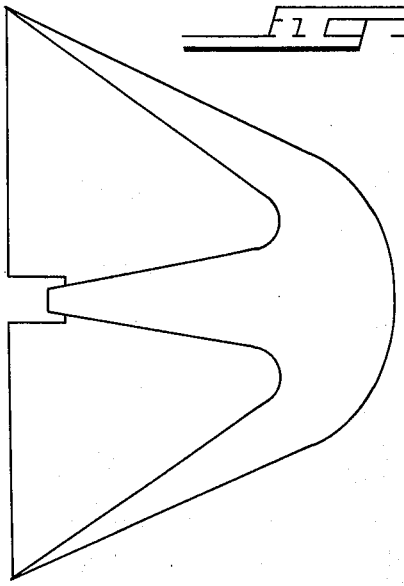
FIG. 7 is a top view of another kite shown for comparative purposes.

I have also found that the ratio of overall width to length of the kite is important to obtain superior lift and stability of the kite of this invention. I have found that the ratio of overall width to length (W/L) must be about 0.5 to 1.5. Preferably, W/L is about 0.9 to 1.3. FIG. 7 for comparison, shows a kite of general similarity to the kite of FIG. 5 except the W/L ratio is about 2. The kite shown in FIG. 7 had insufficient lift and stability to fly in a moderate breeze. All of the above relationships refer to the inflated kite.

The trailing edge of webs 13*a* and 13*b* may have a wide variety of shapes. The shape shown in FIG. 1 as solid lines and identified as A, extending from the extremity of side members 11*a* and 11*b* to the trailing edge of body member 10 is one preferred shape. The minimum web size to obtain good flying characteristics is approximated by dotted lines B and C, while line D illustrates a straight tailing edge. Webs 13*a* and 13*b* may be scalloped or of any other desired shape as exemplified by dotted lines A and C. It has been found that to obtain the superior lift and stability characteristics of a kite of this invention, the web of flexible sheet material connected between each side member and body member should extend over at least about 50 percent of the area defined by the body member, the side member and a straight line connecting the rear extremities of the body member and side member. The webs may extend rearwardly of the rear extremity of the body and provide tailing edges for the kite. Webs 13*a* and 13*b* may be taut as shown by dotted lines E in FIG. 2 or, preferably, have some sag as shown by solid lines F in FIG. 2. The degree of sag is governed by the extent of shoulders 15*a* and 15*b*.

It is desired that webs 13*a* and 13*b* be of flexible material and not inflated. For comparison, a kite of the same size and proportions as the kite shown in FIG. 5 was fabricated wherein seals 16*a* and 16*b* were maintained except for an interior passage to body member 10, permitting webs 13a and 13b to be inflated. The inflation of webs 13a and 13b was found to considerably decrease the lift characteristics of the kite and also to reduce the stability characteristics.

To further show the desirability of webs 13a and 13b being uninflated, a kite of the same size and proportions as the kite shown in FIG. 5 was fabricated omitting seals 16*a* and 16*b* so that webs 13*a* and 13*b*, body member 10 and projecting side members 11*a* and 11*b*, were inflated into a single chamber of teardrop shape. The kite so constructed was not flyable, having lost essentially all of its lift and having poor stability.

Still further, a kite was fabricated of the same size and proportions as the kite shown in FIG. 5, except that an inflated tube was extended across the trailing edge A of webs 13*a* and 13*b*. The inflated tube was of the general nature shown in U.S. Pat. No. 2,733,880. Such a kite did not achieve the objects of this invention as it showed greatly reduced lift, requiring strong kite-flying winds to fly.

Figure 3:
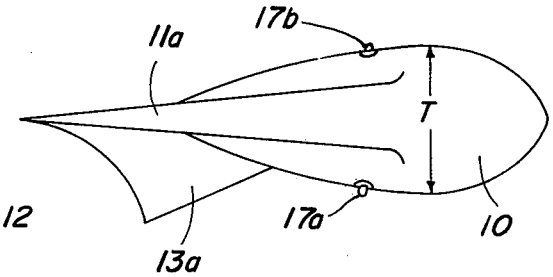
FIG. 3 is a side elevational view of the kite shown in FIG. 1.
Figure 2:
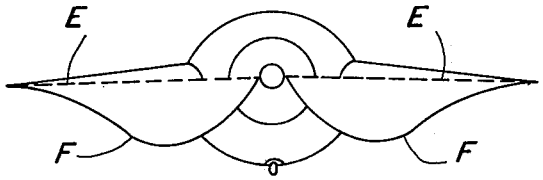
FIG. 2 is a rear elevational view of the kite shown in FIG. 1.

The kite as shown in FIGS. 1, 2 and 3, is preferably flown from a single line secured to attachment means shown in FIG. 3 as 17*a*. The kite may be flown with multiple points of attachment or multiple lines which merely reduce the requirement for high lift and stability requirements of the kite itself. The attachment means 17*a* may be any suitable plastic cloth material bonded to the kite and having suitable means for attachment of string, monofilament lines, or the like. Attachment means 17a is located aft of the area of maximum thickness of the teardrop shape of body member 10 of the kite, i.e., aft of the thickest portion of body member 10. Since the kite of this invention is symmetrical, a second attachment means 17*b* may be attached at a corresponding location on the top side of the kite to permit the kite to be flown with either side up.

To obtain the most advantageous lift characteristics, the maximum thickness of the inflated body, shown as T in FIG. 3, should be about 0.15 to 0.45 L, as shown in FIG. 1. Preferably, T is about 0.30 L.

Vent means 14 may be placed at any suitable location so that when air or a lifting gas is blown inwardly, the body member 10 and side members 11*a* and 11*b* in communication with body member 10, are inflated. After inflation, vent means 14 may be twisted and/or folded upon itself and tied or fastened by a rubber band. Vent means 14 may also be in the form of any suitable one-way valve or self-sealing aperture.

I have found contrary to the teachings of U.S. Pat. No. 3,003,722, which teaches a plurality of interconnected hollow inflated chambers in an inflatable kite, that a single, generally rigid inflated body and rearwardly projecting side members are desirable to obtain the superior performance of the kite of this invention.

I have found contrary to the teachings of U.S. Pat. No. 3,335,985 which teaches attachment of a single string in the region of maximum thickness of an inflated kite, that the kite of this invention preferably has a string attachment means 17*a* located aft of the maximum thickness region. When the string attachment means is located as shown in FIG. 3, the kite of this invention flies at an angle of about 45° to 80° from horizontal, depending on wind conditions, exhibiting constant lift and excellent stability.

From the above comparative kites, it is seen that in order to achieve the benefits of the kite of this invention, the nose is rounded, the relation W over L is 0.5 to 1.5, the rearwardly projecting side members are about as long as the body and preferably longer, and the rearwardly projecting side members and the body portion are connected with an uninflated web occupying at least 50 percent of the area between the rearwardly projecting side members 11*a* and 11*b* and body member 10. To obtain maximum stability in small sizes it is preferred the rounded nose portion be discontinuous with the outer edges of the projecting side members by having lateral projections continuous with the rounded nose portion and a narrow neck portion ahead of the attachment of the projecting side members to the body.

The kite of this invention may be economically fabricated, preferably from two sheets of a thin thermo-plastic material, such as polyethylene, having the same configuration and sealing the entire periphery of the two sheets, one to the other, except for inflation opening 14; and sealing the two sheets at seals 16*a* and 16*b*, all such seals being air tight to form the single chamber inflated shape such as shown in FIGS. 1 and 4. Any gas impervious sheet material which has the ability to conform to the desired shapes as shown may be used.

The kite of this invention has been found to perform well without any auxiliary tail in mild breezes as well as high winds. If desired, however, the kite of this invention may be flown with a tail of single or multiple ribbons attached at the rear portion of the body.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A kite comprising:

an inflatable rearwardly tapering body member provided with a rounded leading edge and having substantially teardrop shape, two inflatable opposing rearwardly projecting side members attached to said body member and together forming a single inflated volume wherein said rounded leading edge at its extremities defines lateral projections on each side which are shaped into a narrower neck portion, the width across said lateral projections being about 15 to about 200 percent greater than the width across said neck portion, said neck portion being shaped at the rearward end into the outer edges of said side members;

a non-inflatable web of flexible sheet material connected between the trailing edge of each rearwardly projecting side member and said body member and said web extending over at least 50 percent of the area defined by the edges of said body member, the inner edge of each side member and straight lines joining the rear extremities of said body member and each of said side members;

a line attachment means bonded to said body member; and the ratio of the maximum width of the kite when inflated to the length of the kite being 0.5 to 1.5 and the maximum thickness of said body member when inflated is 0.15 to 0.45 of said length.

2. The kite of claim 1 wherein said rearwardly projecting side members extend beyond said body member.

3. The kite of claim 1 wherein said rearwardly projecting side members are tapered toward their extremities.

4. The kite of claim 1 wherein said web is taut.

5. The kite of claim 1 wherein said web has sag.

6. The kite of claim 1 wherein said line attachment means is bonded to said body member aft of the thickest portion of said body member.

7. The kite of claim 1 having a vent means at the rear of said body member.

8. The kite of claim 1 wherein said ratio of width to length is 0.9 to 1.3.

9. The kite of claim 1 wherein said web extends rearwardly of the rear extremity of said body member and forms a trailing edge.

10. The kite of claim 1 wherein said body member has a length of about 12 to about 18 inches.

11. The kite of claim 1 wherein the width across said lateral projections is about 25 to about 100 percent greater than the width across said neck portion.

12. The kite of claim 1 wherein the width of said neck portion is about 10 to about 30 percent of the extreme width of said kite.

* * * * *